United States Patent [19]

Cordes

[11] 4,344,349

[45] Aug. 17, 1982

[54] RIM SHOT SEGMENT

[76] Inventor: Charles P. Cordes, 27 Kenneth Pl., Clark, N.J. 07066

[21] Appl. No.: 276,744

[22] Filed: Jun. 24, 1981

[51] Int. Cl.[3] ..... G10D 13/02

[52] U.S. Cl. ..... 84/411 R; 84/452 P; 84/453

[58] Field of Search ..... 84/411 R, 411 A, 411 M, 84/411 P, 415, 452 P, 453

[56] References Cited

U.S. PATENT DOCUMENTS

| | | | |
|---|---|---|---|
| 504,910 | 9/1893 | Cox | 84/411 R |
| 2,779,227 | 1/1957 | Slingerland | 84/411 R |
| 3,981,220 | 9/1976 | Clark | 84/415 |
| 4,283,985 | 8/1981 | Famularo | 84/411 R |

FOREIGN PATENT DOCUMENTS

| | | | |
|---|---|---|---|
| 463824 | 4/1937 | United Kingdom | 84/411 R |

*Primary Examiner*—Lawrence R. Franklin
*Attorney, Agent, or Firm*—Sughrue, Mion, Zinn, Macpeak & Seas

[57] ABSTRACT

An arcuate rim shot segment of plastics material is provided for attachment to a drum adjacent the metal hoop thereof to prevent damage to a wooden drum stick during rim shot. The rim shot segment has a semi-cylindrical cross-sectional configuration with the flat surface thereof adapted to engage and extend above the internal circumferential surface of the drum hoop. Flexible plastic strips of material extend about the arcuate segment in spaced relation and define tabs for securement between the drum hoop and the drum shell.

4 Claims, 3 Drawing Figures

RIM SHOT SEGMENT

BACKGROUND OF THE INVENTION

The present invention is directed to a rim shot segment adapted to be connected to a drum and more specifically to an arcuate strip of plastics material secured against the inside of the drum hoop against the drum head and extending upwardly above the top edge of the hoop.

In the art of drumming, a well known technique is to strike the drum sticks against the hoop or rim of the drum to achieve a clicking sound. Since the drum sticks are usually constructed of wood and the hoop or rim of the drum of metal, the drum sticks rapidly become dented and/or splintered as a result of using the rim shot technique.

It is old and well known in the art to modify the configuration of the metal hoop or rim of the drum in order to minimize damage to the drum sticks when striking the rim. Such modified hoop constructions are shown in U.S. Pat. No. 2,261,120 to Ludwig et al, U.S. Pat. No. 2,779,227 to Slingerland, Jr. and U.S. Pat. No. 3,186,289 to Kester, Jr. While such hoop configurations tended to minimize the damage to the wooden drum sticks, a considerable amount of damage still occurred to the drum sticks and the rim shot sound still tended to have a generally harsh metallic click.

SUMMARY OF THE INVENTION

The present invention provides a new and improved arrangement for substantially eliminating all damage to drum sticks as a direct result of the rim shot technique while producing a more mellow, pleasent sound.

The present invention provides an attachment for a drum in the form of an arcuate segment of plastics material adapted to be secured with the drum head between the drum shell and drum hoop with the segment disposed in contact with the drum head and the inner circumferential surface of the hoop while extending above the hoop so as to prevent contact of the drum sticks with the metal hoop. The arcuate segment according to the present invention preferably extends approximately 180° about the circumference of the hoop and is provided with a semicylindrical cross-section with the flat surface thereof bearing against the internal circumferential surface of the hoop. A plurality of plastic straps extend about the arcuate segment in spaced relation to each other with the ends thereof secured between the drum hoop and drum shell in substantially the same manner in which the head is secured.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
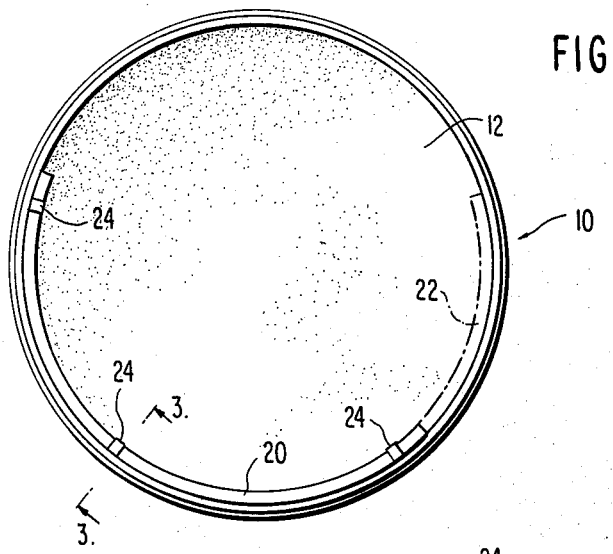
FIG. 1 is a top plan view of a drum showing the rim shot segment secured in place.
Figure 3:
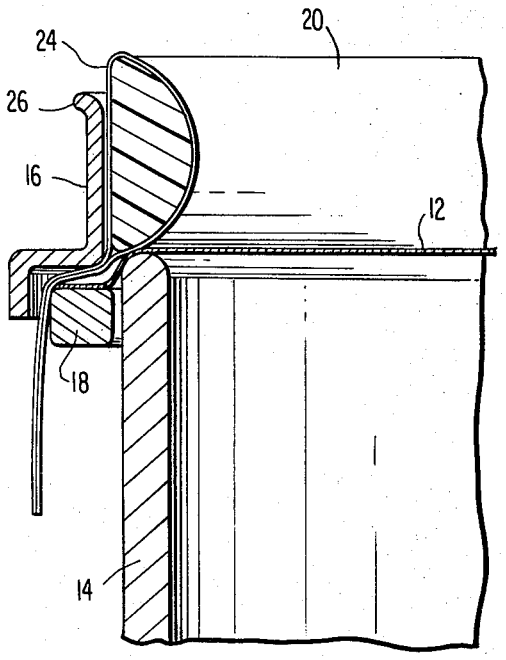
FIG. 3 is a sectional view taken along the line III—III of FIG. 1.

The drum 10 shown in FIGS. 1 and 3 is comprised of a drum head 12 tautly secured across the upper end of a drum shell 14 by means of a drum hoop 16. The hoop 16 is secured to the shell by conventional securing means and the drum head 12 has a conventional annular rim 18 secured thereto by any suitable means.

Figure 2:
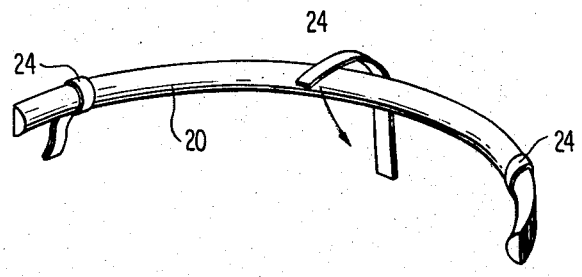
FIG. 2 is a perspective view of the rim shot segment and securing straps therefor.

The rim shot segment 20 according to the present invention is comprised of an arcuate segment of plastics material having a semicylindrical cross-section as best seen in FIGS. 2 and 3. While the arcuate segment can extend about the circumference of the hoop 16 to any desired extent, it is preferred to have the segment extend substantially 180° about the internal circumference of the rim as shown in FIG. 1. An additional segment 22 shown in dot-dash lines can be provided at the illustrated position or any other suitable position to provide for cross-sticking.

The segment 20 is secured against the internal circumferential surface of the metal drum hoop 16 by means of a plurality of high strength plastic tapes 24. The inside surfaces of the tapes extending about the segment 20 may be provided with a suitable adhesive for securing the two ends of each tape to each other as best seen in FIGS. 2 and 3. The secured ends then act as a tab which extends between the drum shell 14 and the drum hoop 16 to permit tension to be applied to the segment 20 while the drum hoop 16 is being secured to the drum shell 14. In fact, the tightening of the drum head further tightens the segment against the hoop and shell.

As best seen in FIG. 3, the segment 20 is dimensioned so as to extend above the rim 26 of the hoop 16 so as to prevent the drum stick from striking the metal hoop. By having the segment constructed of plastics material, it is possible to vary the durometer of the plastics material and choose a durometer lower than that of the drum stick so that the segment will depress under a hard blow without making a dent or cut in the wooden drum stick. The plastics material, however, has a recovery characteristic such that the segment will regain its semi-cylindrical configuration as illustrated. The rounded surface of the segment 20 gives a broad contact surface for the stick and by having the segment 20 in firm intimate contact with the hoop and shell of the drum, the tonal characteristics of the rim shot are enhanced instead of having the usual metallic click associated with a wooden drum stick striking a metal hoop. The lower the durometer of the plastics material, the lower will be the pitch of the sound, thereby giving rounder more mellow tones.

It is obvious that the circumferential extent of the segment may be varied and that the segment may be broken up into several smaller segments depending upon the wishes of the drummer. Thus, while the invention has been particulary shown and described with respect to a preferred embodiment thereof, it will be understood by those in the art that various changes in form and details may be made therein without departing from the spirit and scope of the invention.

What is claimed is:

1. A rim shot segment adapted to be attached to a drum in contact with the drum head and internal circumferential surface of the drum hoop comprising an arcuate segment of plastics material having a semicylindrical cross-sectional configuration including a flat surface and a rounded surface and means for securing said arcuate segment to a drum with said flat surface bearing against the internal circumferential surface of the drum hoop and a portion of the rounded surface bearing against the drum head where the drum head engages the drum shell.

2. A rim shot segment as set forth in claim 1, wherein the width of said flat surface of said arcuate segment is greater than the height of the drum hoop above the drum head so hat a drum stick will only strike the arcuate segment without contacting the drum hoop.

3. A rim shot segment as set forth in claim 2, wherein the durometer of said plastics material is less than the durometer of a drum stick to be used with the rim shot segment.

4. A rim shot segment as set forth in claim 1, wherein said means for securing said arcuate segment to the drum are comprised of a plurality of thin strips of material extending about said arcuate segment in spaced apart relation and defining tab means adapted to be secured between the drum shell and the drum hoop.

* * * * *